US005266121A

United States Patent [19]

Cioletti

[11] Patent Number: 5,266,121

[45] Date of Patent: Nov. 30, 1993

[54] METHOD OF CLEANING PHOTOGRAPHIC PROCESSING EQUIPMENT

[75] Inventor: Kenneth R. Cioletti, Wayne, N.J.

[73] Assignee: Helion Industries, Inc., Belleville, N.J.

[21] Appl. No.: 928,354

[22] Filed: Aug. 12, 1992

[51] Int. Cl.[5] ..... B08B 9/08

[52] U.S. Cl. ..... 134/3; 134/22.19; 134/26; 134/42; 252/94; 252/100; 252/102

[58] Field of Search ..... 423/32; 134/3, 22.19, 134/42, 26; 252/94, 100, 102

[56] References Cited

U.S. PATENT DOCUMENTS

| | | | |
|---|---|---|---|
| 3,625,908 | 6/1968 | Magin | 134/3 |
| 3,945,828 | 3/1976 | Iwano | 430/464 |
| 4,021,264 | 5/1977 | Knorre et al. | 134/42 |
| 4,678,597 | 7/1987 | Keiner | 134/22.19 |

*Primary Examiner*—Theodore Morris
*Assistant Examiner*—Thomas G. Dunn, Jr.
*Attorney, Agent, or Firm*—Wegner, Cantor, Mueller & Player

[57] ABSTRACT

Three aqueous cleaning solutions are disclosed, which may be used individually or as part of a two-solution cleaning method for silver halide-based photographic processing systems. One solution comprises water, an organic or inorganic iron salt wherein the iron is in the +3 oxidation state, a chelating agent, and an organic or inorganic silver complexing agent. A second solution comprises water, an organic or inorganic acid or acid anhydride, a surfactant, and a water soluble solvent. A third solution comprises water, a chelating agent, an alkali metal silicate salt, a surfactant, and a water soluble solvent.

21 Claims, No Drawings

METHOD OF CLEANING PHOTOGRAPHIC PROCESSING EQUIPMENT

FIELD OF THE INVENTION

The present invention is directed to aqueous chemical solutions useful in the cleaning of photographic processing tanks and trays.

BACKGROUND OF THE INVENTION

Traditionally, manual photographic processing involved the use of at least four separate solutions: a developer to reduce the silver in the latent image to metallic silver, a stop bath to arrest the developer, a fixer to remove undeveloped silver halide salts, and a wash bath to remove residual fixer. The need for high speed developing has led to automatic processors which develop photographic film and paper.

A typical automatic processor comprises three tanks: a developer tank, a fixer tank, and a wash tank. To increase production speed, the stop bath is eliminated. However, this requires that the fixer solution be formulated with high buffering capacity to neutralize the alkaline developer carried over with the photographic film or paper.

After prolonged use, deposits can form on the surfaces of the various tanks and also on the mechanical roller/belt systems used to transport the photographic materials through the processor. In the developer tank, the deposits can be metallic silver, silver salts, and alkali metal salts. In the fixer tank, the deposits can be silver salts, alkali metal salts, and elemental sulfur. Finally, in the wash tank, the deposits can be alkali metal salts, gelatin, and gelatin by-products.

The prior art discloses the use of separate cleaning compositions for the developer and fixer tanks. A strong oxidizer plus a solvent for silver salts is used on the developer tank. Typically, such a cleaner includes chromic acid or chromate salts plus sulfuric or sulfamic acid. The cleaner can be formulated as a powder or liquid. In addition, a neutralizer, such as an alkali bisulfite solution, is used to remove residual chromate salts. Other variations include alkaline powders which are combinations of alkali thiosulfate and ammonium sulfate or other ammonium salts. More recently, a powdered product consisting of a peroxymonosulfate compound, sold under the name OXONE (a trademark of E. I. Dupont de Nemours Company), and citric acid has been developed.

The major problem with non-chromate based cleaners is the time involved in cleaning. The OXONE TM-/citric acid cleaner usually requires at least eight to ten hours to effectively remove all residues. Even after this time, it does not always remove the organic "tar" residues found in tanks used for processing color film and paper.

In cleaning the fixer tank, a strong caustic solution, such as sodium or potassium hydroxide, is normally employed to dissolve the silver complexes and salts. In addition, powdered products are available which typically consist of trisodium phosphate. Such caustic solutions suffer the disadvantages of being injurious to the eyes and skin. Also, phosphates are banned in many localities. The wash tanks are normally contaminated with alkali metal salts and gelatinous residue resulting from the growth of microorganisms in the tank and gelatin residue from the film or paper. Generally, chlorine bleach is used to clean and disinfect the wash tanks.

However, chlorine bleach does not effectively dissolve alkaline metal salts.

DETAILED DESCRIPTION OF THE INVENTION

The object of the present invention is to provide an effective system for cleaning photographic processor tanks, while eliminating caustic solutions and chromium compounds and reducing cleaning time to around 30 minutes. Utilizing a three-part system, the invention provides versatility in cleaning depending on the degree to which deposits have built up in the tanks. The present invention effectively removes silver, silver residues, and organic deposits from all portions of the processor. The three-part system comprises three aqueous solutions, which may be stored separately to promote storage life, and which are useful in the cleaning of processor tanks.

One embodiment of the present invention is a cleaning solution, referred to as solution A, which comprises water, an organic or inorganic iron salt wherein the iron is in the +3 oxidation state, a chelating agent, and an organic or inorganic silver complexing agent. Solution A has a pH in the range of about 5.0 to about 8.5 and can be used to clean developer or fixer tanks.

A second embodiment of the present invention is a cleaning solution, referred to as solution B, which comprises water, an organic or inorganic acid or acid anhydride, a surfactant, and a water soluble solvent. The pH of solution B ranges from about 1.0 to about 5.0, depending on the particular acid, and may be used to clean developer or fixer tanks.

A third embodiment of the present invention is a cleaning solution, referred to as solution C, which comprises water, a chelating agent, an alkali metal silicate salt, a surfactant, and a water soluble solvent. This solution may be used to clean the fixer tank.

A fourth embodiment of the present invention is a method of cleaning a photographic processor comprising the steps of filling the processor with one of solutions A, B, or C, draining, and rinsing with water.

A fifth embodiment of the present invention is a two-solution method of cleaning a photographic processor comprising the steps of filling the processor with solution A, draining, rinsing with water, filling the processor with solution B, draining, and rinsing with water.

Suitable chelating agents include EDTA; DPTA; hydroxy(EDTA); sodium, potassium, or ammonium salts of EDTA; sodium or potassium salts of hydroxyethyl ethylene diamine triacetic acid; sodium or potassium salts of diethylene triamine pentaacetic acid; Na Fe EDTA; and ferric ammonium EDTA.

Suitable silver complexing agents include sodium, potassium, or ammonium thiosulfate; sodium, potassium, or ammonium thiocyanate; sodium dithionate; alkyl alkanolamines; alkyl amines; thiourea; alkyl thiourea; cysteine HCl; ammonium dithiocarbamate; monoethanolamine oxalate; and alkanolamine oxalates.

Suitable silver oxidizing agents include ferric chloride; ferric ammonium sulfate; ferric nitrate; potassium or sodium ferricyanide; ferric sulfate; and other compounds capable of oxidizing metallic silver to its ionic state.

Suitable inorganic acids include phosphoric, nitric, and sulfuric acids.

Suitable organic acids include acetic, oxalic, propionic, hydroxyacetic, trichloroacetic, and citric acids.

Suitable acid anhydrides include acetic and propionic anhydride.

Suitable surfactants include ethoxylated nonylphenols; linear alcohol ethoxylates; alkanolamine; and potassium or sodium salt of dodecylbenzene sulfonic acid. Preferred surfactants are nonylphenol 9-12 mole ethylene oxide and linear alcohol ethoxylate 9-12 mole ethylene oxide.

Suitable water soluble solvents include glycol ethers, such as diethylene glycol monobutyl ether, dipropylene glycol monomethyl ether, and propylene glycol monomethyl ether, and alcohols.

In solution A, it is possible to combine the silver oxidizing agent and the chelating agent as the $Fe^{3+}$salt of the chelating agent. A preferred range of mole ratio of chelating agent to $Fe^{3+}$is 1.1-1.2:1. For example, such a combination can be ferric ammonium EDTA.

The invention is more fully described by, though not limited to, the following examples.

EXAMPLES

In the following examples, relative effectiveness of formulations was determined based on the amount of time required to remove the silver from a fully exposed and developed sheet of photographic film. 1"×3" strips were used with 2" of the strip immersed in the solutions at 70 F without agitation.

EXAMPLE 1

The following solutions were utilized:

Solution A1 - 50% $FeCl_3$ solution (38.5% $FeCl_3$) 50% $FeNH_4$(EDTA) solution (52%)

Solution A2 - 25% $FeCl_3$ solution (38.5% $FeCl_3$) 25% $FeNH_4$(EDTA) solution (52%) 50% water Solution A3 - 25% $FeCl_3$ solution (38.5% $FeCl_3$) 75% water Solution A4 - 25% $FeCl_3$ solution (38.5% $FeCl_3$) 25% hydroxy(EDTA) (40.0% active) 50% water Solution A5 - 25% $FeNH_4$(EDTA) (52.0% active) 25% hydroxy(EDTA) (40.0% active) 50% water X - 40% ammonium thiosulfate solution Using the above silver clearing test, the following cleaning solutions were prepared and tested:

| Composition | Silver Clearing Time |
|---|---|
| 10 ml A1 + 10 ml X + 80 ml water | 3 minutes |
| 10 ml A2 + 10 ml X + 80 ml water | 10 minutes |
| 10 ml A3 + 10 ml X + 80 ml water | 15 minutes |
| 10 ml A4 + 10 ml X + 80 ml water | 7 minutes |
| 10 ml A5 + 10 ml X + 80 ml water | 10 minutes |

Thus, the combination of a ferric salt plus a chelating agent gives the fastest clearing time.

EXAMPLE 2

In order to determine the optimum concentration range, a standard solution of ferric ammonium EDTA and ammonium thiosulfate was mixed and tested at various concentrations.

Solution A6 - 50% ferric ammonium EDTA (52%) 50% water

Solution X2 - 70% ammonium thiosulfate (60%) 30% water

| Composition | Silver Clearing Time |
|---|---|
| 2 ml A6 + 2 ml X2 + 96 ml water | 22.0 minutes |

-continued

| Composition | Silver Clearing Time |
|---|---|
| 4 ml A6 + 4 ml X2 + 92 ml water | 17.70 minutes |
| 6 ml A6 + 6 ml X2 + 88 ml water | 14.30 minutes |
| 8 ml A6 + 8 ml X2 + 84 ml water | 11.0 minutes |
| 10 ml A6 + 10 ml X2 + 80 ml water | 9.5 minutes |

From these results, it was calculated that 6.10 g/l to 31.0 g/l of ferric ammonium EDTA produces the best clearing times, although good clearing times can still be obtained at concentrations between 5.0 to 35.0 g/l. The ratio of ammonium thiosulfate to ferric ammonium EDTA was 1.6:1.0, which is suitable for cleaning most systems where silver halide salts are more prevalent than metallic silver, although the ratio can be adjusted to account for differences in the relative amounts of free silver and silver halide. Thus, a suitable concentration range for ammonium thiosulfate is between 7.5 and 55.0 g/l.

EXAMPLE 3

Solutions A6 and X2 were combined and used as the first step in a two-step cleaning process.

(i) Ten ounces of A6 and 10 ounces of X2 were mixed with enough water to make one gallon of solution. This was placed in a photographic processor with heavy deposits of silver and other inorganic salts. The solution was allowed to sit in the tank for 10 minutes and then drained. This was followed by a water rinse and then by step (ii).

(ii) A solution B was prepared as follows:

water—28.0% phosphoric acid (85%)—66.0% nonionic surfactant—5.0% butyl carbitol—1.0%

Solution B was mixed with water at a concentration of 10 ounces B/gallon of water. A preferable concentration range for solution B is 5% to 15%, which is sufficient to neutralize any residue from step (i) and to effectively remove any organic residue. The processor was filled with the mixture of solution B and water and allowed to sit for 10 minutes. The tank was then drained and rinsed with water.

After the two-step treatment, no mineral deposits, organic substances or metallic silver remained on any processor surfaces which had been treated.

EXAMPLE 4

A solution C was prepared as follows:

water—80.00%

$Na_4$ $_{EDTA}$—1.50% sodium metasilicate (ANH)—11.00% butyl carbitol—5.00% surfactant—2.50% A processor as described in Example 3 was used. 1O ounces of solution C per gallon of water was added to the fixer tank of the processor and allowed to stand for 30 minutes. A preferable concentration range for solution C is 10-5%. The tank was then drained and rinsed.

All mineral deposits and visible soils were removed from the fixer tank and treated surfaces.

I claim:

1. A method of cleaning the surfaces of a photographic processor in a silver halide based photographic system comprising first contacting the surfaces of the photographic processor with a first composition which comprises water, an organic or inorganic iron salt wherein the iron is in the +3 oxidation state, a chelating agent, and an organic or inorganic silver complexing agent, rinsing the surfaces with water, and then contacting the surfaces with a second composition which comprises water, an organic or inorganic acid or acid anhydride, a surfactant, and a water soluble solvent.

2. A method according to claim 1 further comprising diluting the first composition in water to a concentration of 4–20 oz composition/gallon of water before contacting the surfaces of the photographic processor.

3. A method according to claim 1, wherein the chelating agent is selected from the group consisting of EDTA, sodium salts of EDTA, potassium salts of EDTA, ammonium salts of EDTA, sodium salts of hydroxyethyl ethylene diamine triacetic acid, potassium salts of hydroxyethyl ethylene diamine triacetic acid, sodium salts of diethylene triamine pentaacetic acid, potassium salts of diethylene triamine pentaacetic acid, Na Fe EDTA, and ferric ammonium EDTA.

4. A method according to claim 1, wherein the silver complexing agent is selected from the group consisting of sodium thiosulfate, potassium thiosulfate, ammonium thiosulfate, sodium thiocyanate, potassium thiocyanate, ammonium thiocyanate, sodium dithionate, alkyl alkanolamines, alkyl amines, thiourea, alkyl thiourea, cysteine HCl, ammonium dithiocarbamate, monoethanolamine oxalate, and alkanolamine oxalates.

5. A method according to claim 4, wherein the silver complexing agent is ammonium thiosulfate.

6. A method according to claim 5, wherein the ammonium thiosulfate is present in the concentration range of 20–45% by weight of the composition.

7. A method according to claim 1, wherein the silver oxidizing agent is selected from the group consisting of ferric chloride, ferric ammonium sulfate, ferric nitrate, potassium ferricyanide, sodium ferricyanide, and ferric sulfate.

8. A method according to claim 1, wherein the silver oxidizing agent is $Fe^{3+}$.

9. A method according to claim 1, wherein the silver oxidizing agent and the chelating agent are combined as the $Fe^{3+}$ salt of the chelating agent.

10. A method according to claim 9, wherein the mole ratio of chelating agent to $Fe^{3+}$ is 1.1–1.2:1.

11. A method according to claim 9, wherein the $Fe^{3+}$ salt of the chelating agent is ferric ammonium EDTA.

12. A method according to claim 11, wherein the ferric ammonium EDTA is present in the concentration range of 10–35% by weight of the composition.

13. A method according to claim 1, wherein the pH of the second composition is between about 1.0 and about 5.0.

14. A method according to claim 1, wherein the inorganic acid of the second composition is selected from the group consisting of phosphoric acid, nitric acid, and sulfuric acid.

15. A method according to claim 13, wherein the inorganic acid is phosphoric acid which is present in the concentration range of 40–60% by weight of the second composition.

16. A method according to claim 14 further comprising diluting the second composition of claim 14 in water to a concentration of 7.5–65.0 g phosphoric acid/l of solution before contacting the surfaces of the photographic processor.

17. A method according to claim 1 further comprising diluting the second composition in water to a concentration of 2–10 oz composition/gallon of water before contacting the surfaces of the photographic processor.

18. A method according to claim 1, wherein the organic acid of the second composition is selected from the group consisting of acetic acid, oxalic acid, propionic acid, hydroxyacetic acid, trichloroacetic acid, and citric acid.

19. A method according to claim 1, wherein the acid anhydride of the second composition is selected from the group consisting of acetic anhydride and propionic anhydride.

20. A method according to claim 1, wherein the surfactant of the second composition is selected from the group consisting of ethoxylated nonylphenols, linear alcohol ethoxylates, alkanolamine, potassium salt of dodecylbenzene sulfonic acid, and sodium salt of dodecylbenzene sulfonic acid.

21. A method according to claim 1, wherein the water soluble solvent of the second composition is selected from the group consisting of glycol ethers and alcohols.

* * * * *